US005842885A

United States Patent [19]

Takamoto et al.

[11] Patent Number: 5,842,885

[45] Date of Patent: Dec. 1, 1998

[54] BIASED EDGE CARD SHIELDED CONNECTOR

[75] Inventors: Junji Takamoto, Kyoto; Kazunori Koshiishi, Hirakata; Katsutoshi Tojo, Machida, all of Japan

[73] Assignees: Molex Incorporated, Lisle, Ill.; Nintendo Kabushikikaisya, Kyoto, Japan

[21] Appl. No.: 745,535

[22] Filed: Nov. 12, 1996

[30] Foreign Application Priority Data

Nov. 20, 1995 [JP] Japan ..... 7-325086

[51] Int. Cl.[6] ..... H01R 13/648

[52] U.S. Cl. ..... 439/607; 439/60

[58] Field of Search ..... 439/607–610, 439/636, 637, 60, 108

[56] References Cited

U.S. PATENT DOCUMENTS

| | | | |
|---|---|---|---|
| 3,149,893 | 9/1964 | Dupre | 439/60 |
| 4,023,877 | 5/1977 | Hannessey et al. | 339/17 F |
| 4,895,522 | 1/1990 | Grabbe et al. | 439/63 |
| 5,035,631 | 7/1991 | Piorunneck et al. | 439/108 |
| 5,195,911 | 3/1993 | Murphy | 439/607 |
| 5,203,725 | 4/1993 | Brunker et al. | 439/636 |
| 5,273,460 | 12/1993 | Arai | 439/609 |
| 5,281,169 | 1/1994 | Kiat et al. | 439/607 |
| 5,288,247 | 2/1994 | Kaufman | 439/607 |
| 5,288,248 | 2/1994 | Chen | 439/609 |
| 5,423,691 | 6/1995 | Pickles | 439/327 |
| 5,557,507 | 9/1996 | Koike et al. | 439/607 |
| 5,580,257 | 12/1996 | Harwath | 439/108 |

*Primary Examiner*—Hien Vu
*Attorney, Agent, or Firm*—Charles S. Cohen

[57] ABSTRACT

An edge connector is provided for a printed circuit board having a mating edge and a plurality of contact pads adjacent the edge. The connector includes an elongated dielectric housing having an elongated mating portion with a board-receiving slot for receiving the mating edge of the printed circuit board. A plurality of spring contact elements are mounted in the housing along one side of the slot and extending into the slot for contacting respective ones of the contact pads on the printed circuit board. A shield is mounted on the housing substantially about the mating portion. The shield has at least one resilient portion extending into the slot for contacting the printed circuit board and biasing the board against the spring contact elements.

11 Claims, 8 Drawing Sheets

BIASED EDGE CARD SHIELDED CONNECTOR

FIELD OF THE INVENTION

This invention generally relates to the art of electrical connectors and, particularly, to a biased edge card connector having a conductive shield which provides a biasing means.

BACKGROUND OF THE INVENTION

In today's high speed electronic equipment, it is desirable that all components in an interconnection path be optimized for signal transmission characteristics, otherwise the performance of the system will be impaired or degraded. Such characteristics include risetime degradation or system bandwidth, crosstalk, impedance control and propagation delay. Ideally, the characteristics of an electrical connector would have little or no affect on the interconnection system. An ideal connector would be "transparent". In other words, the system would function as if the connector did not exist as part of the interconnection. However, such an ideal connector is generally impractical or impossible, and continuous efforts are made to develop electrical connectors which have as little affect on the system as possible.

It has been found that inductance is one of the major concerns in designing an ideal connector. This is particularly true in electrical connectors for high speed electronic equipment, i.e. involving the transmission of high frequencies. A very popular type of electrical connector for such applications commonly is termed an "edge card" connector. In other words, an edge connector is provided for receiving a printed circuit board having a mating edge and a plurality of contact pads adjacent the edge. Such edge connectors have an elongated housing defining an elongated slot for receiving the mating edge of the printed circuit board. A plurality of terminals are spaced along one or both sides of the slot for engaging the contact pads adjacent the mating edge of the board. Most often, the terminals have some form or another of spring contact elements for biased engagement against the contact pads on the board and, most often, the spring contact elements are in one form or another of a cantilevered spring arm.

With electrical connectors of the character described above, given electrical contacts of otherwise comparable geometry, the longer the spring contact arm or contact beam, the greater the inductance of the terminal and, cumulatively, the electrical connector itself. Therefore, it is desirable to have as short a contact beam as possible. Shortening the contact beam creates various problems. For instance, it is difficult to maintain constant contact pressures in a multiplicity of spring contact beams, particularly when the beams are relatively short. In addition, it is difficult to compensate for variances in the widths of printed circuit boards when the contact beams are short. In fact, such spring contacts can take a permanent set even when the contacts are displaced only a small amount. The contacts might take a permanent set after a relatively wide printed circuit board has been inserted into the connector. This permanent set of the contacts would make the connector ineffective when a relatively narrow board subsequently is inserted into the connector. If the contact beams do not make effective electrical connection with the contact pads on the edge of the printed circuit board, an unreliable or ineffective electrical connection results, rendering the connector effectively useless.

U.S. Pat. No. 5,203,725 to Brunker et al, dated Apr. 23, 1993 and assigned to the assignee of the present invention, shows a biased edge card connector directed to solving these problems. That patent discloses an edge card connector of the character described wherein the deflection of the spring contact elements is controlled, resulting in the ability to design very short spring contact beams. Various biasing means are disclosed, including a second, unitary spring portion of one or more of the spring contact elements. In another embodiment, the biasing means may be provided by an integral portion of the connector housing, such as a unitarily molded portion of a plastic housing. In another embodiment, the biasing means may be provided by a spring device mounted on the housing independent of the spring contact elements. Still further, the biasing means may be provided by a cam member, independent of the housing and the spring contact elements, positionable in a board-receiving slot means for camming the printed circuit board against the spring contact elements.

The present invention is directed to providing an edge card connector of the character described wherein the deflection of the spring contact elements is achieved by a shield that surrounds a substantial portion of the connector housing, thereby avoiding any modifications to the connector housing or to the spring contact elements, or the necessity of additional extraneous biasing means or cam members.

SUMMARY OF THE INVENTION

An object, therefore, of the invention is to provide a new and improved shielded edge connector for a printed circuit board having a mating edge and a plurality of contact pads adjacent the edge.

Generally, the edge connector includes a dielectric housing having an elongated mating portion with a board-receiving slot for receiving the edge of the printed circuit board. A shield is mounted on the housing substantially about the mating portion. A plurality of spring contact elements are mounted in the housing along one side of the slot. The spring contact elements have spring contact portions extending into the slot for contacting respective ones of the contact pads on one side of the printed circuit board.

The housing includes surface means at the one side of the slot defining a datum plane beyond which the spring contact portion of at least one of the spring contact elements extends into the slot. Biasing means is provided in the housing for biasing the printed circuit board against the surface means, thereby deflecting the spring contact portion of at least one spring contact element a predetermined amount.

The invention herein contemplates that the biasing means comprise a resilient portion of the shield extending into the slot for contacting the printed circuit board on a side of the board opposite the aforesaid one side thereof and biasing the one side of the board against the surface means and the spring contact elements.

In the preferred embodiment, the shield is stamped and formed of sheet metal material. The slot includes an entry mouth into which the mating edge of the printed circuit board is inserted. The resilient portion of the shield comprises an integral cantilevered spring arm which is bent from the exterior of the mating portion of the housing through the mouth and into the slot. The cantilevered spring arm has a width, lengthwise of the slot, substantially greater than the width of the slot.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

FIGS. 1–9 show an edge connector, generally designated 1, for receiving a mating edge of a printed circuit board (as described hereinafter). The connector includes an elongated housing 2 of dielectric material, such as of molded plastic. A plurality of terminals, generally designated 3, are inserted into the housing through a bottom board-mounting surface 2*a* of the housing. A metal shell or shield, generally designated 4, is positioned over a substantial portion of the housing. The shield is stamped and formed of conductive sheet metal material to the desired shape and size.

Figure 1:
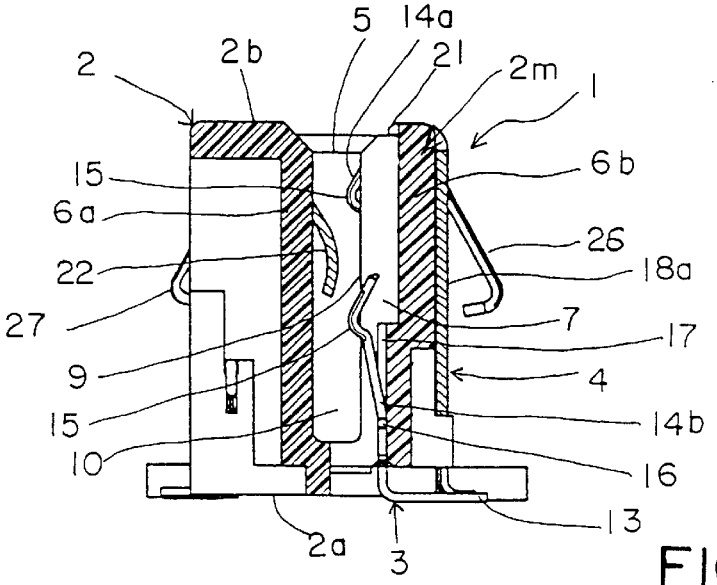
FIG. 1 is a vertical section taken generally along line 1—1 of FIG. 6.
Figure 2:
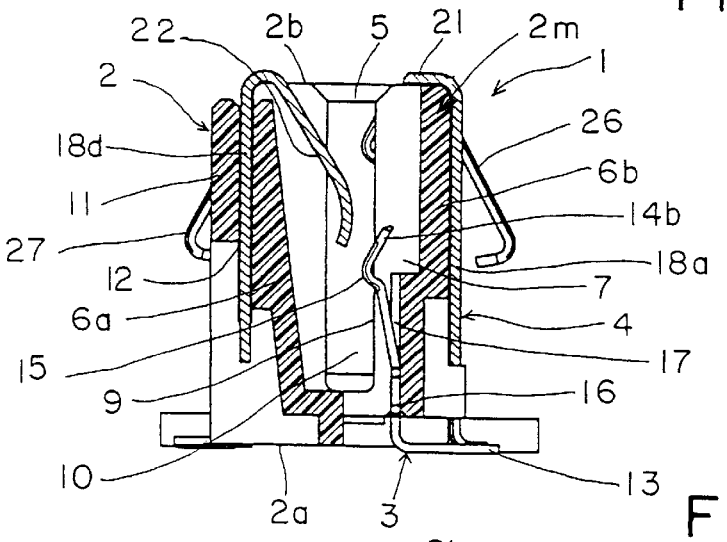
FIG. 2 is a vertical section taken generally along line 2—2 of FIG. 6.
Figure 3:
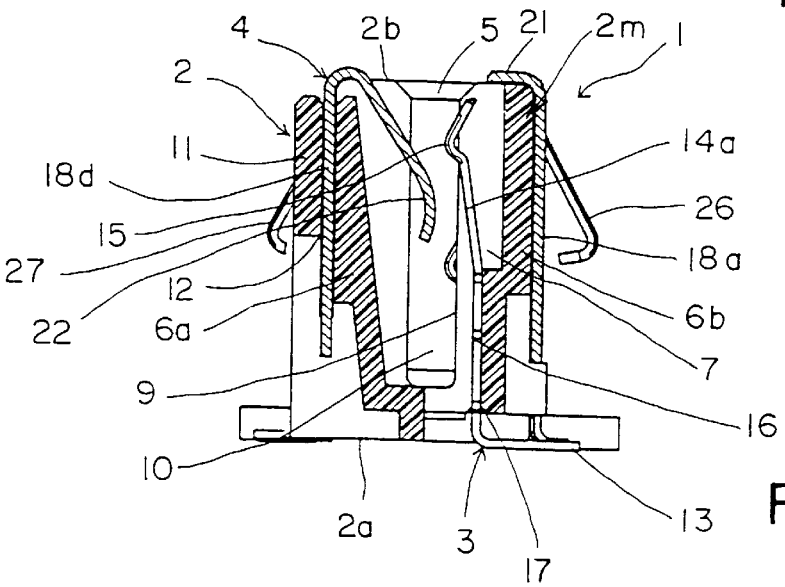
FIG. 3 is a vertical section taken generally along line 3—3 of FIG. 6.

As best seen in FIGS. 1, 2 and 3, elongated housing 2 includes a mating portion, generally designated 2*m*, which has a longitudinal slot 5 defined between a pair of opposite longitudinal side walls 6*a* and 6*b*. The longitudinal slot opens at a top surface 2*b* of the housing for receiving the mating edge of the printed circuit board. One of the opposite walls 6*b* has a plurality of recesses 7 spaced at regular intervals longitudinally in its inner surface. The inside edges of walls 6*b*, between recesses 7, define a datum plane 9. The recesses 7 accommodate terminals 3.

Figure 4:
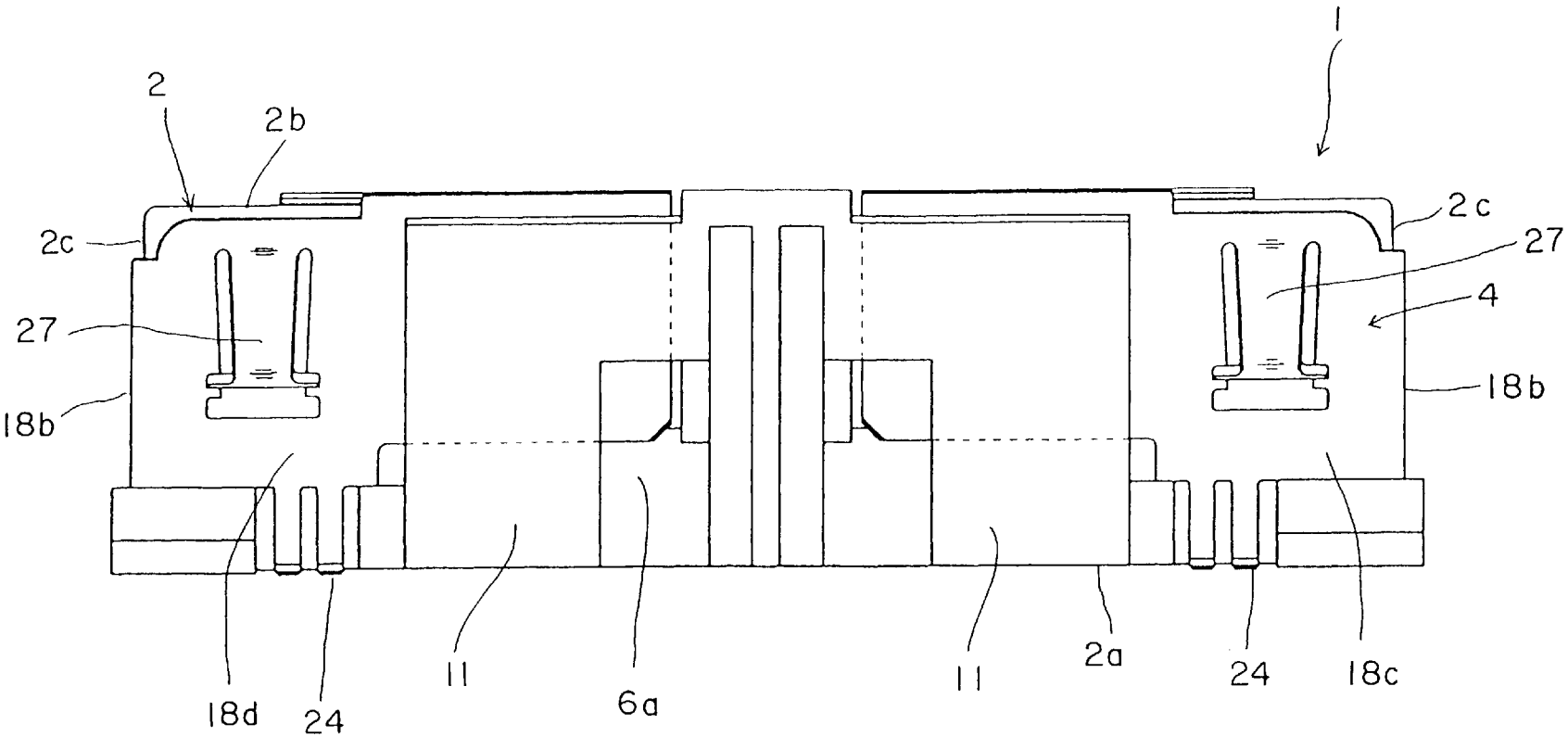
FIG. 4 is a front elevational view of an edge connector according to the invention.
Figure 5:
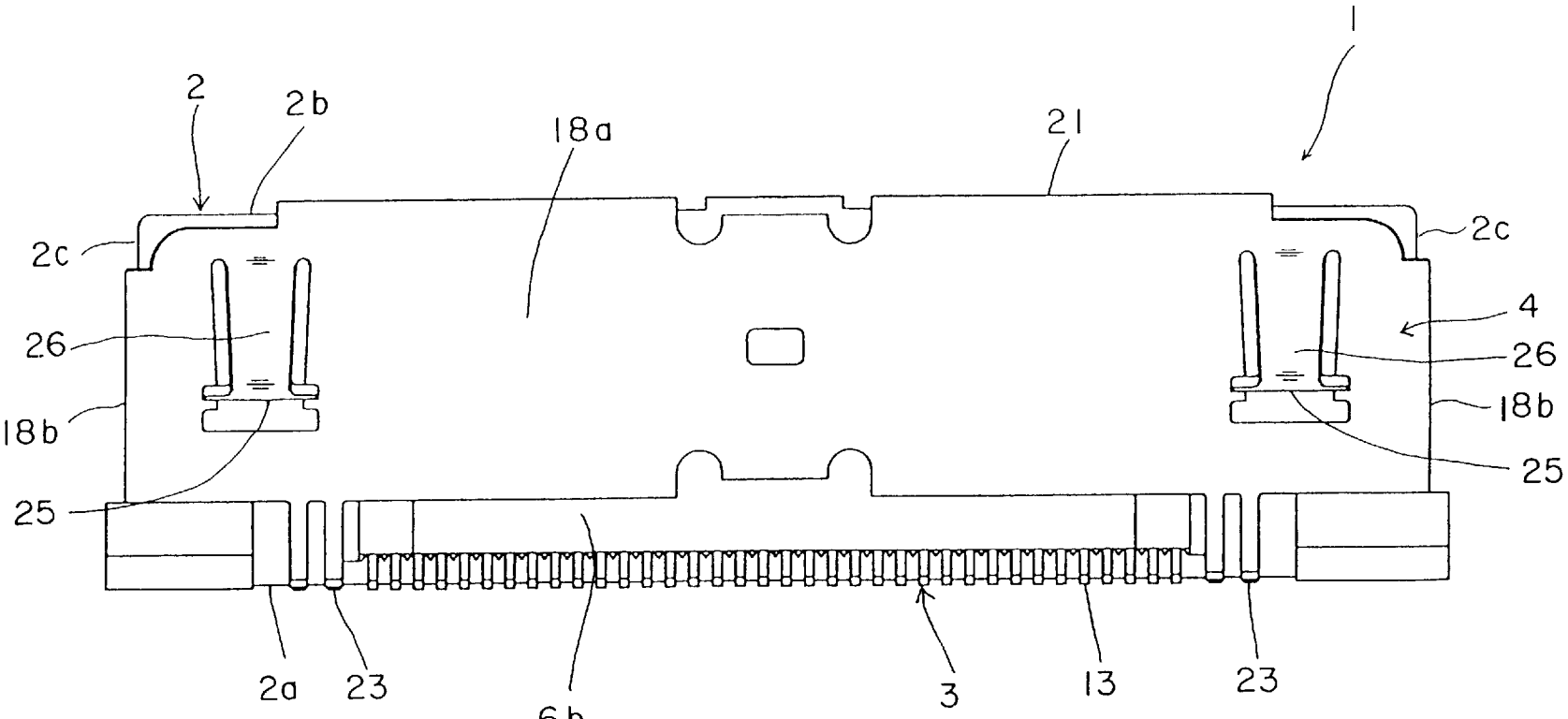
FIG. 5 is a rear elevational view of the connector.

More specifically, each terminal recess 7 extends the full height of housing 2 to open both at top surface 2*b* and bottom board-mounting surface 2*a* of the housing, permitting the terminals to be inserted into the recesses from the bottom of the housing. Datum plane 9 will face one major plane or side of the printed circuit board, at the edge of the board, when the board is inserted into slot 5 of the housing. The other opposite wall 6*a* is chamfered at its top corner, thereby defining a diverging inlet or mouth at the top of longitudinal slot 5. The slot defines a vertical space 10 which communicates with the top or diverging inlet of the slot and functions to guide the mating edge of the printed circuit board downwardly into the slot. As best seen in FIG. 4, wall 6*a* has an outer, integral plate portion 11 which, as seen in FIG. 4, is formed by two inverted L-shaped portions integrally connected at their tops or abutting ends, leaving a narrow space between wall 6*a* and the outer plate portion 11 for inserting the metal shield 4, as seen in FIGS. 2 and 3.

The plurality of terminals 3 actually are provided by alternating short terminals (FIGS. 1 and 2) and long terminals (FIG. 3) lengthwise of the elongated housing and board-receiving slot 5. Each long terminal (FIG. 3) has a long contact stem 14*a* and a solder tail 13 integrally connected to contact stem 14*a*. Each short terminal has a short contact stem 14*b* and a solder tail 13 integrally connected to contact stem 14*b*. All of the terminals are mounted in the housing with their solder tails 13 generally flush with bottom 2*a* of the housing, i.e. generally coplanar for soldering to appropriate circuit traces on the printed circuit board. The alternating arrangement of long and short terminals 3 allows for an increasing density of circuit pads at the edge of the printed circuit board. Each contact stem 14*a* and 14*b* has a contact portion 15 projecting into slot 5 near the distal end of the contact stem. In other words, with the terminals mounted within recesses 7, contact portions 15 extend into the slot beyond datum plane 9 towards the opposite wall 6*a*. Contact stems 14*a* and 14*b* have pointed projections or teeth 16 at their opposite edges for digging into grooves 17 formed in walls 6*a* at the sides of recesses 7 to fix the terminals in the housing.

Referring to FIGS. 4–9 in conjunction with FIGS. 1–3, metal shield 4 is stamped and formed into an elongated rectangular hollow shape. The shield includes a major section 18*a* covering substantially the entire area of wall 6*b* of housing 2. The shield has two minor sections 18*b* integrally connected to the opposite ends of major section 18*a* at right angles for covering end walls 2*c* of the housing. The shield further includes two semi-major sections 18*c* and 18*d* integrally connected to minor sections 18*b* at right angles thereto for covering the opposite end areas of the other wall 6*a* of the housing. As best seen in FIG. 4, semi-major sections 18*c* and 18*d* extend toward each other, leaving a rectangular space at the center of housing wall 6*a*. The shield has fitting nails 23 and 24 projecting from its lower periphery. The shield is mounted on housing 2 from the top of the housing to substantially enclose the housing.

When metal shell or shield 4 is mounted on housing 2, the major section 18*a* of the shield covers substantially the entire area of the one side wall 6*b* of the housing. The two minor sections 18*b* of the shield substantially cover the end walls 2*c* of the housing. The two semi-major sections 18*c* and 18*d* cover a substantial portion of the opposite end areas of the other opposite side wall 6*a* of the housing. The two semi-major sections 18*c* and 18*d* are sandwiched between the outer plate portions 11 of the housing and wall 6*a* of the housing. As seen in FIGS. 2 and 3, metal shield 4 has a longitudinal lip 21 extending inwardly from the top edge of major section 18*a* to abut against the top edge of wall 6*b* of the housing when the shield is fully mounted on the housing.

The invention contemplates that metal shell or shield 4 include two resilient portions in the form of cantilevered spring arms 22 formed integrally with semi-major sections 18*c* and 18*d* of the shell. The spring arms are formed or bent so that they extend downwardly into slot 5 as is clearly seen in FIGS. 2 and 3. The cantilevered spring arms contact the printed circuit board inserted into slot 5 on a side of the board opposite the side which has contact pads for engaging contact portions 15 of terminals 3. In essence, the resilient portions provided by cantilevered spring arms 22 bias the board against the spring contact portions and datum plane 9.

Figure 6:
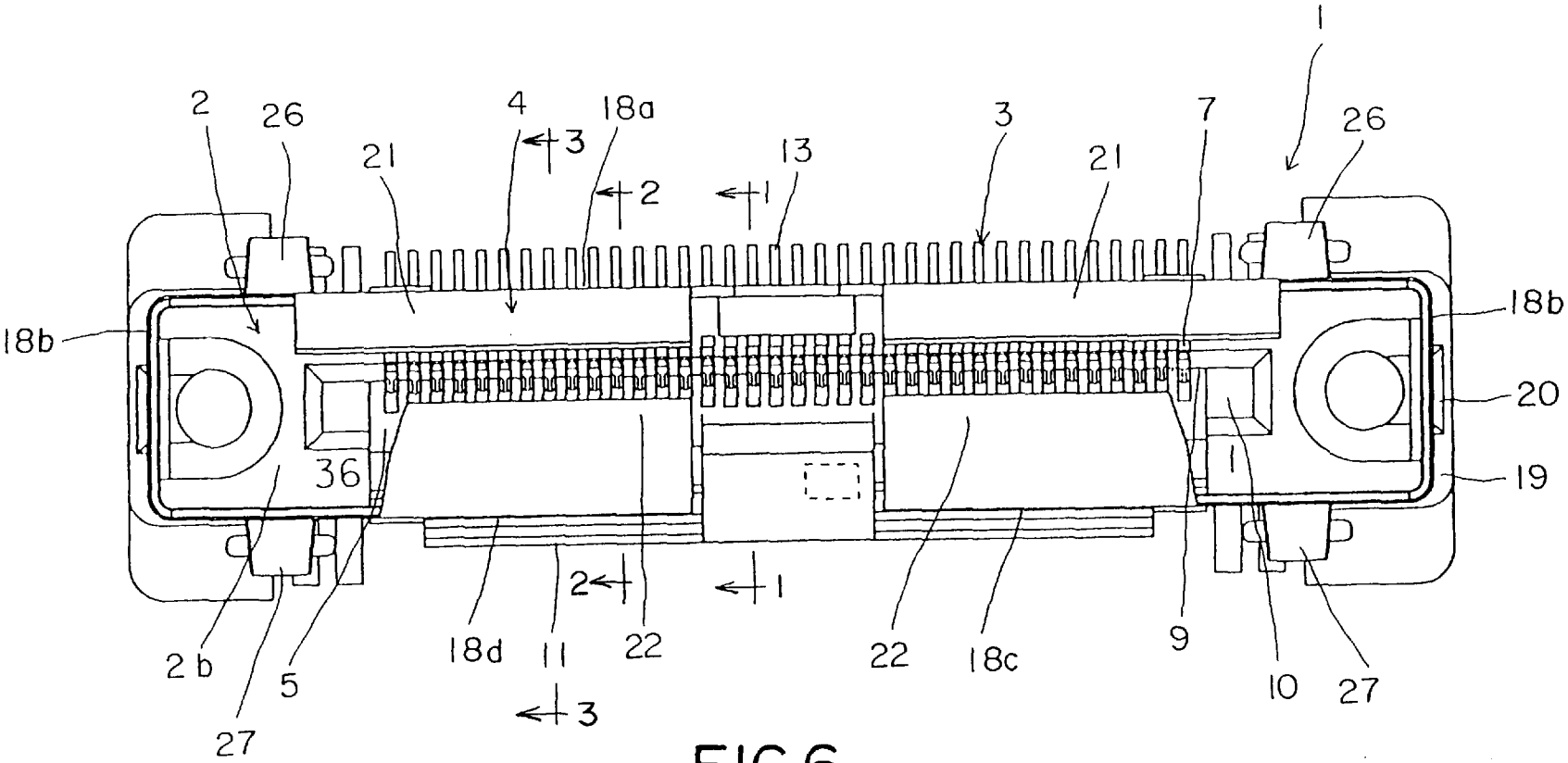
FIG. 6 is a top plan view of the connector.
Figure 7:
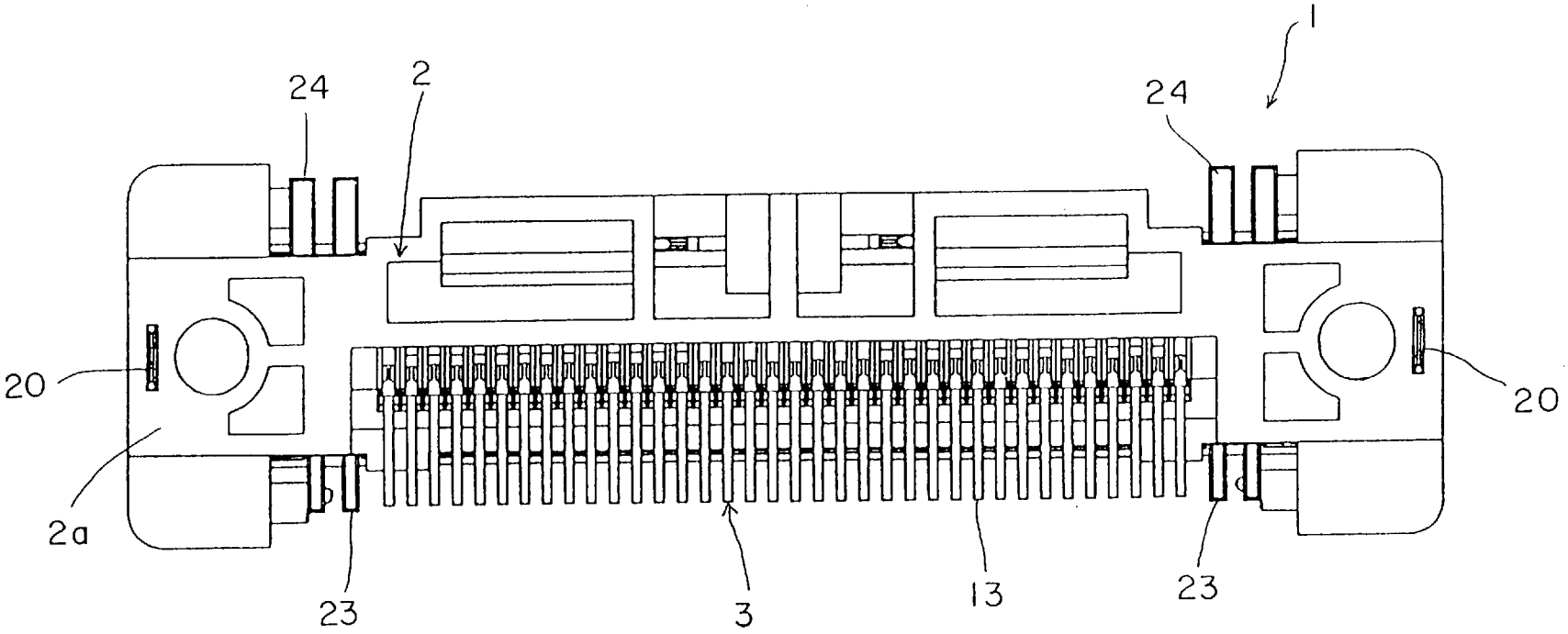
FIG. 7 is a bottom plan view of the connector.

As seen in FIG. 6, the width of each cantilevered spring arm 22 of shield 4 is substantially greater than the width of slot 5. More importantly, the combined width of the two cantilevered spring arms is greater than the combined width of contact stems 14*a* and 14*b* of terminals 3 so that the cantilevered spring arms bias the printed circuit board against surface means or datum plane 9, overcoming the spring forces of the terminals. In other words, the spring forces of the cantilevered spring arms must be greater than the spring forces of the terminals so that the spring arms are effective to bias the edge card or printed circuit board against datum plane 9.

Figure 8:
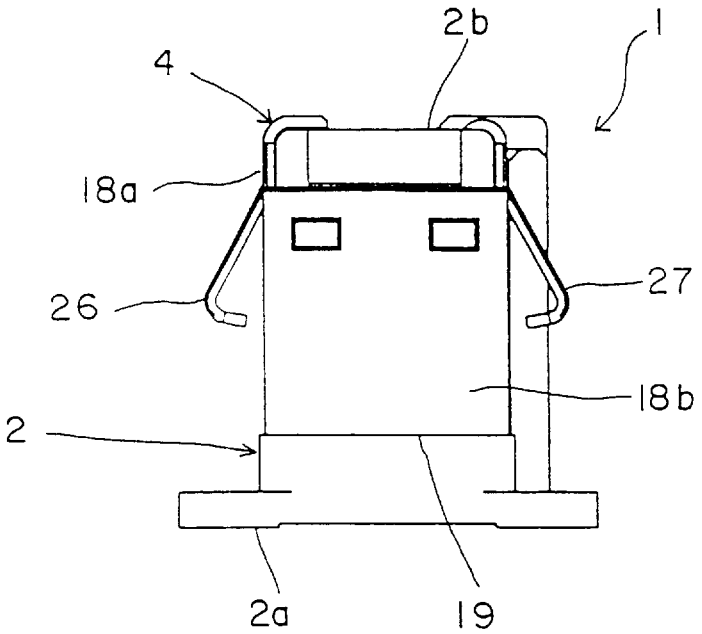
FIG. 8 is an end elevational view of the connector, looking toward the left-hand of FIGS. 4–7.
Figure 9:
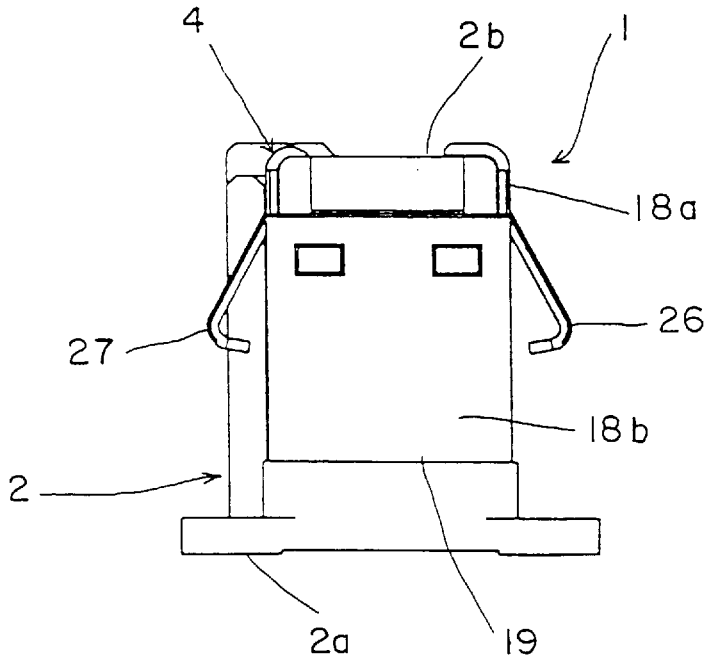
FIG. 9 is an end elevational view of the connector, looking toward the right-hand end of FIGS. 4–7.

As stated above, metal shield 4 has fitting nails 23 and 24 integrally formed at its lower edge. These fitting nails extend downwardly to be flush with bottom surface 2*a* of the housing when the metal shield is mounted on the housing. In addition, major section 18*a* of the metal housing has two T-shaped pieces 25 (FIG. 5) at its opposite end areas. Each T-shaped piece 25 is bent inwardly at its free end and is bowed outwardly to define a spring finger 26. Similarly, semi-major sections 18*c* and 18*d* of the shield have spring fingers 27 at the opposite side of the connector and are positioned symmetrical with spring fingers 26 with respect to housing 2. These spring fingers 26 and 27 are bowed outwardly from the exterior of shield 4 as best seen in FIGS. 8 and 9 for engaging a complementary connecting device positioned over mating portion 2*m* of the connector, as described hereinafter in relation to FIG. 11. The spring fingers may be used as grounding means for the complementary connecting device and/or to provide a resilient retaining means therefor.

It should be understood that the combined widths of cantilevered spring arms 22 (i.e. their spring forces) should be greater than the spring forces applied by spring fingers 26 and 27 on the outside of the shield against the complementary connecting device which is associated with the edge card or printed circuit board, so that spring fingers 26 and 27 do not interfere with or prevent cantilevered spring arms 22 from performing their function of biasing the edge card against datum plane 9 and contact stems 14*a* and 14*b* of terminals 3.

The electrical connector 1 described above is surface mounted on a mother board 28 as described hereinafter with reference to FIG. 11. Soldering tails 13 of terminals 3 are soldered to selected circuit traces or pads on the mother board and, at the same time, fitting nails 22 and 24 of the metal shield are soldered to appropriate grounding pads (not shown) on the mother board, thus fixing edge connector 1 to the mother board.

Figure 10:
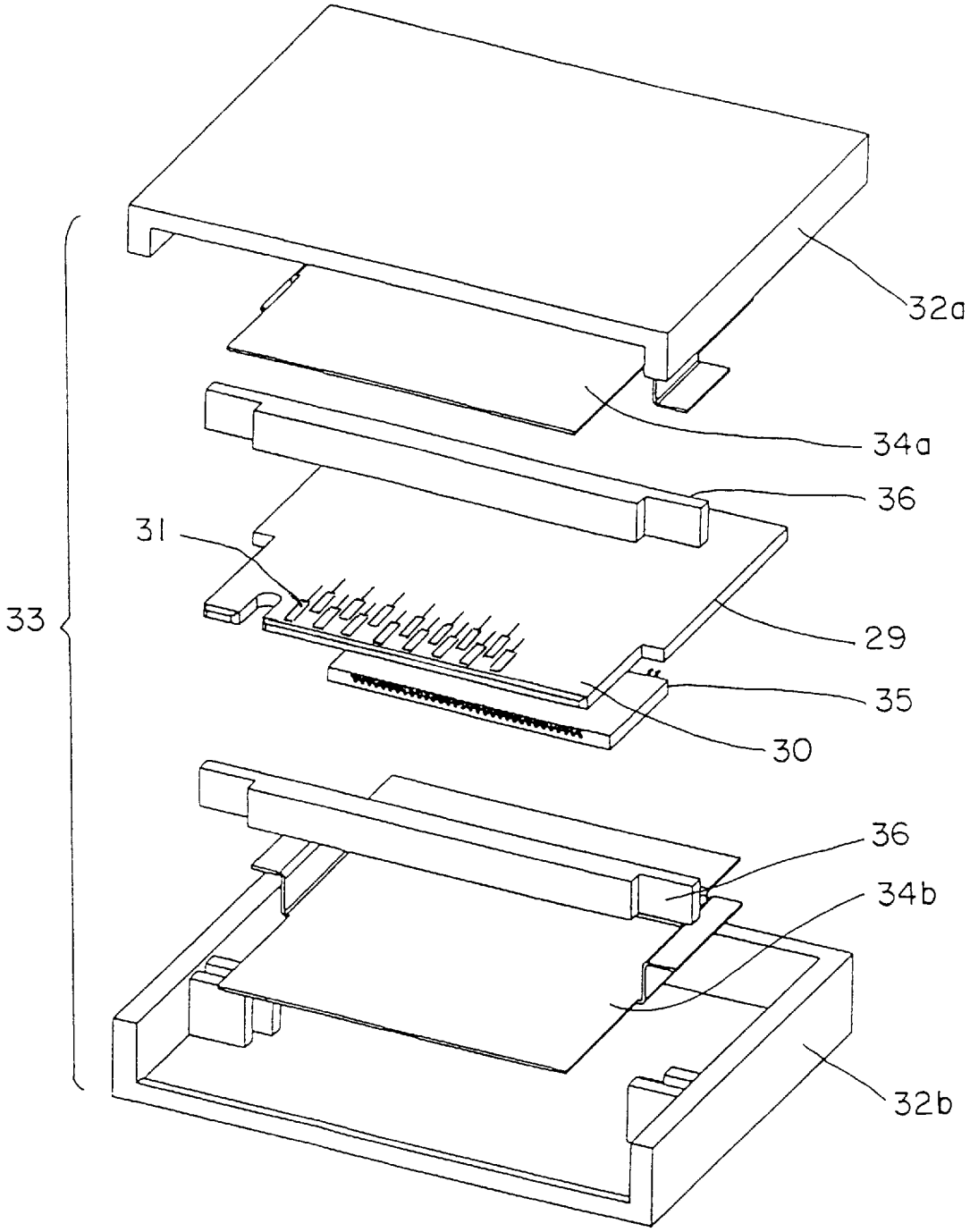
FIG. 10 is an exploded perspective view of a cassette for containing a printed circuit board.

Referring to FIG. 10, a printed circuit board 29 is shown to have a mating edge 30 for insertion into longitudinal slot 5 of edge connector 1. The printed circuit board has contact pads 31 spaced along the mating edge on one of the two opposite major surfaces of the board. The contact pads are arranged in two lines for registering with the longer and shorter contact stems 14*a* and 14*b*, respectively, of terminals 3. A cassette 33 includes two halves 32*a* and 32*b* secured together to form a box-like casing having an opening on one side. Printed circuit board 29 is contained in the casing with its mating edge 30 disposed at the opening in the casing, thereby permitting interconnection of the edge of the board with edge connector 1. Cassette 33 has a pair of metal shielding plates 34*a* and 34*b* to cover opposite sides of printed circuit board 29 when it is mounted within casing 33. In the drawing, a ROM 35 is attached to the printed circuit board, and a pair of support pieces 36 are used to hold the printed circuit board in casing 33.

Figure 11:
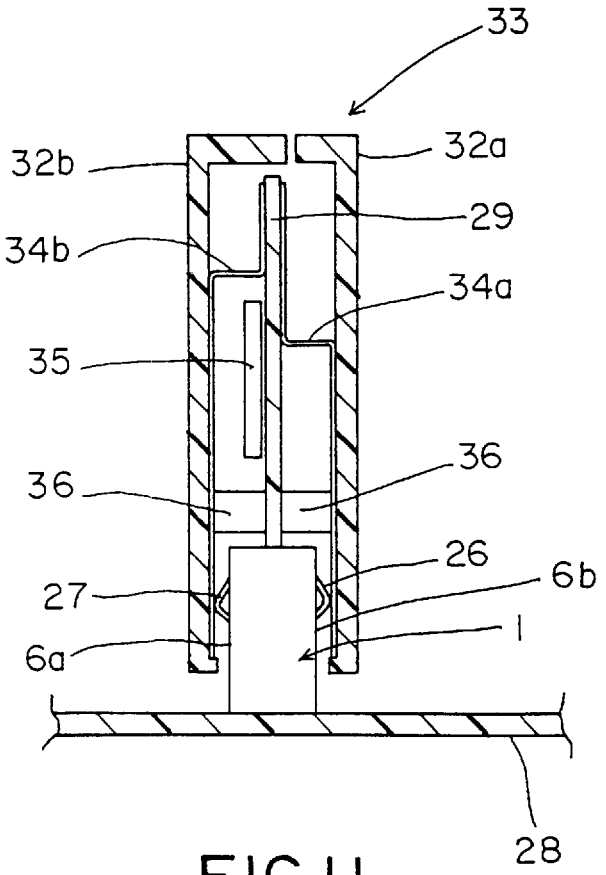
FIG. 11 is a vertical section through the cassette showing how it is positioned over the edge connector, with the edge of the printed circuit board inserted into the connector.

Referring to FIG. 11, printed circuit board 29 of cassette 33 is connected to mother board 28 through edge connector 1. When connector housing 2 is inserted into the lower opening of cassette 33, mating edge 30 of printed circuit board 29 is guided into slot 5 of the connector housing. While the mating edge of the printed circuit board 29 is guided into vertical space 10 of housing 2, the mating edge is biased toward datum plane 9 of the connector housing by resilient spring arms 22 of shield 4. At the same time, the resilient contact stems 14*a* and 14*b* of terminals 3 are biased from their stress-free positions to biased positions in which the contact stems are aligned generally flush with datum plane 9. Therefore, resilient spring arms 22 of shield 4 function as biasing means both for the mating edge of printed circuit board 29 and for the contact stems of terminals 3.

Figure 12:
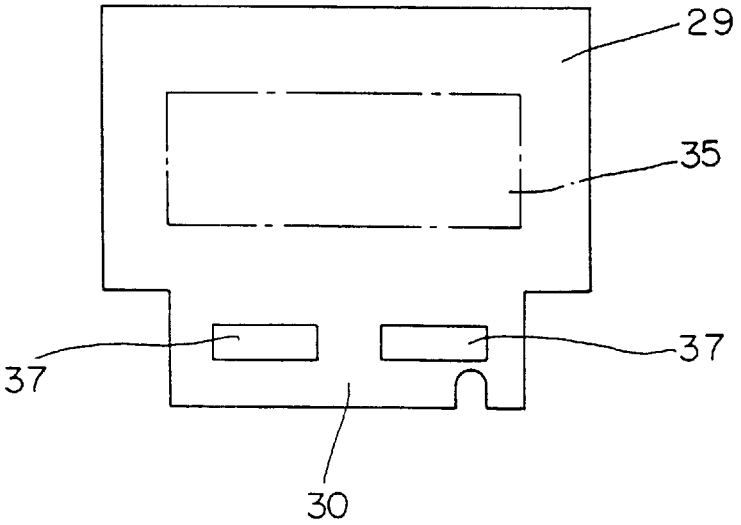
FIG. 12 is a plan view of one side of the printed circuit board on which conductive ground pads are formed.

As seen best in FIGS. 2 and 3, resilient spring arms 22 of shield 4 are bowed or bent at their free ends similar to the contact stems of terminals 3 to define contact portions of the spring arms. These contact portions engage grounding contact pads 37 formed on the side of printed circuit board 29 opposite the side which has contact pads 31 (as seen in FIG. 12). Therefore, metal shield 4 is electrically connected to a grounding circuit on printed circuit board 29.

Referring back to FIG. 11, when the encased printed circuit board 29 is inserted into edge connector 1, shielding plates 34*a* and 34*b* of cassette 33 contact spring fingers 26 and 27, respectively, of metal shield 4. Therefore, printed circuit board 29 and terminals 3 of edge connector 1 are completely surrounded by shield plates 34*a* and 34*b* and metal shield 4, respectively, and the grounding circuit of mother board 28 is electrically connected to the grounding circuit of printed circuit board 29 through shield plates 34*a* and 34*b* and metal shield 4. Consequently, all associated grounding parts are kept at the same ground potential, providing complete shielding of the printed circuit from surrounding electromagnetic waves, or preventing electromagnetic waves from radiating from the printed circuit.

Metal shield 4 can be modified by eliminating spring fingers 26 and 27 and, accordingly, shield plates 34*a* and 34*b* can be modified by adding extra resilient extensions to contact the major section 18*a*, semi-major sections 18*c* and 18*d* of the metal shield 4. Also, the metal shield can be modified by removing fitting nails 23 and, accordingly, the housing can be modified by adding extra fitting nails thereto.

Because of the interconnection between cantilevered spring arms 22 and grounding pads 37 of printed circuit board 29, it is unnecessary for some selected terminals to be used for grounding part of the printed circuit. Therefore, all of the terminals can be allotted signal transmission functions. This is advantageous to connection of high-bit circuits. Relatively extensive contact is made between each grounding pad 37 of printed circuit board 29 and spring arms 22 of metal shield 4 and, therefore, an excellent shielding effect is assured. Remaining terminals, if any, may be connected to the grounding circuit of the printed circuit board. Lastly, in the embodiment described herein, metal shield 4 is a separate part assembled to housing 2 of edge connector 1. However, the metal shield could be insert-molded in the walls of the housing, although the independent assembly of the shield probably is easier than the insert molding of the shield.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an edge connector for receiving a printed circuit board having a mating edge and a plurality of contact pads adjacent the edge, said connector including an elongated dielectric housing having an elongated mating portion with a board-receiving slot for receiving the mating edge of the printed circuit board, a shield mounted on the housing substantially about said mating portion, and a plurality of spring contact elements mounted in the housing along one side of the slot and extending into the slot for contacting respective ones of the contact pads on one side of the printed circuit board, said plurality of spring contact elements applying a contact force against said printed circuit board away from said one side of said slot, and biasing means for biasing the printed circuit board against the spring contact elements, the improvement comprising:

said biasing means being a resilient portion of the shield extending into said slot for contacting the printed circuit board on a side opposite said one side of the board and biasing said one side of the board against said spring contact elements with a biasing force that is greater than said contact force, and said slot includes an entry mouth into which the mating edge of the printed circuit board is inserted, and said resilient portion of the shield comprises a spring arm folded over the mating portion through the mouth into the slot.

2. In an edge connector as set forth in claim 1, wherein said shield is a stamped and formed sheet metal structure and said spring arm is a cantilevered member.

3. In an edge connector as set forth in claim 2, wherein said slot is an elongated opening in said connector housing with elongated sides and including a plurality of said cantilevered spring arms extending over a major portion of one of said elongated sides of the slot.

4. An edge connector for receiving a printed circuit board having a mating edge and a plurality of contact pads adjacent the edge, said connector including an elongated dielectric housing having an elongated mating portion with a board-receiving slot for receiving the mating edge of the printed circuit board, a shield mounted on the housing substantially about said mating portion, said shield including at least one spring finger projecting from the exterior thereof for engaging a ground plate positioned with respect said mating portion, and a plurality of spring contact elements mounted in the housing along one side of the slot and having spring contact portions extending into the slot for contacting respective ones of the contact pads on one side of the printed circuit board, a surface on the housing at said one side of the slot defining a datum plane beyond which the spring contact portions of the spring contact elements extend into the slot, and biasing means for biasing the printed circuit board against the surface, thereby deflecting the spring contact portions of said spring contact elements a predetermined amount, said biasing means being a resilient portion of the shield extending into said slot for contacting the printed circuit board on a side opposite said one side of the board and biasing with a biasing force said one side of the board against said datum plane and said spring contact portions, said biasing force against said one side of the board being sufficiently greater than the spring force applied by said spring finger with respect to said ground plate that the spring finger does not prevent the resilient portion from properly biasing the board against the datum plane and the spring contact portions; and said slot includes an entry mouth into which the mating edge of the printed circuit board is inserted, and said resilient portion of the shield comprises a spring arm folded over the mating portion through the mouth into the slot.

5. In an edge connector as set forth in claim 4, wherein said shield is a stamped and formed sheet metal structure and said spring arm is a cantilevered member.

6. In an edge connector as set forth in claim 5, wherein said slot is an elongated opening in said connector housing with elongated sides and including a plurality of said cantilevered spring arms extending over a major portion of one of said elongated sides of the slot.

7. In an edge connector as set forth in claim 4, including a plurality of said spring fingers on the outside of the shield with at least one spring finger on each opposite longitudinal side of the elongated mating portion.

8. An edge connector for receiving a cassette having a printed circuit board with a mating edge and a plurality of contact pads adjacent the edge and having shielding plates adjacent opposite sides of said printed circuit board, comprising:

an elongated dielectric housing having an elongated mating portion with a board-receiving slot for receiving the mating edge of the printed circuit board;

a plurality of spring contact elements mounted in the housing along one side of the slot and extending into the slot for contacting respective ones of the contact pads on the printed circuit board, said plurality of spring contact elements exerting a contact force against said pads; and a shield mounted on the housing substantially about said mating portion, the shield including a resilient portion extending into said slot for contacting the printed circuit board on the other side of the slot and biasing the board against the spring contact elements along said one side of the slot, said shield further including at least a pair of spring fingers projecting from the exterior thereof for engaging said shielding plates, said biasing force against said one side of the board being sufficiently greater than the spring force applied by said spring fingers against said shielding plates that the spring fingers do not prevent the resilient portion from properly biasing the board against the spring contact elements; and said slot includes an entry mouth into which the mating edge of the printed circuit board is inserted, and said resilient portion of the shield comprises a spring arm folded over the mating portion through the mouth into the slot.

9.The edge connector of claim 8, wherein said shield is a stamped and formed sheet metal structure and said spring arm is a cantilevered member.

10. The edge connector of claim 9, wherein said slot is an elongated opening in said connector housing with elongated sides and including a plurality of cantilevered spring arms extending over a major portion of the one of said elongated sides of the slot.

11. The edge connector of claim 8 wherein said slot includes an entry mouth into which the mating edge of the printed circuit board is inserted, and said resilient portion of the shield comprises a cantilevered spring arm folded over the mating portion through the mouth into the slot.

* * * * *